US006253510B1

(12) United States Patent
Santarossa

(10) Patent No.: US 6,253,510 B1
(45) Date of Patent: Jul. 3, 2001

(54) LIGHTWEIGHT INTERIOR MOULDING

(75) Inventor: Ned Santarossa, Concord (CA)

(73) Assignee: Ontario Limited (CA)

( * ) Notice: Subject to any disclaimer, the term of this patent is extended or adjusted under 35 U.S.C. 154(b) by 0 days.

(21) Appl. No.: 09/448,252

(22) Filed: Nov. 24, 1999

(51) Int. Cl.[7] ..... E04B 2/00

(52) U.S. Cl. ..... 52/287.1; 52/288.1; 52/309.8; 52/716.1; 52/272; 428/69

(58) Field of Search ..... 52/287.1, 309.8, 52/716.1, 288.1, DIG. 8, 272; 428/69

(56) References Cited

U.S. PATENT DOCUMENTS

| | | | | |
|---|---|---|---|---|
| 4,283,894 | * | 8/1981 | Raty | 52/311 |
| 5,819,485 | * | 10/1998 | Lane et al. | 52/287.1 |
| 5,987,835 | | 11/1999 | Santarossa | 52/417 |

FOREIGN PATENT DOCUMENTS

| | | | |
|---|---|---|---|
| 2184205 | 3/1997 | (CA) | E04F/13/00 |

* cited by examiner

*Primary Examiner*—Carl D. Friedman
*Assistant Examiner*—Christy M. Syres
(74) *Attorney, Agent, or Firm*—Mark Kusner

(57) ABSTRACT

The invention relates to a lightweight gypsum coated decorative moulding, for installation on an interior building surface. The moulding is lightweight and flexible enough to withstand handling without cracking of the finished gypsum surface of the moulding. A gypsum coated surface is advantageous in that: fire resistance is enhanced; the moulding can be painted and repaired easily; and liquid gypsum compound can be used as an adhesive to install the lightweight moulding without mechanical fasteners or other support. Bevel joints can be cut with standard carpentry tools and the joints can be secured with liquid gypsum compound as well. The use of liquid gypsum compound as an adhesive and finishing coat ensures accurate fitting and finishing of joints as well as ease of repair. The moulding has an elongate foam core of a resilient expanded polystyrene foam solid, having a cross-sectional profile proportionately smaller than the desired cross-sectional profile of the finished decorative moulding. The core has a rear surface, a decorative surface, and the rear surface includes at least one elongate mounting face for mounting the moulding to the interior building surface. Covering the decorative surface of the foam is a base coating core of hard granular particles, such as silica sand, suspended in an acrylic matrix. The base coating is adapted for liquid application and is cured to produce a relatively rough surface. Covering the base coating on the decorative surface, is a finish coating of gypsum powder suspended in an acrylic matrix. The finish coating is adapted for liquid application and is cured to produce a relatively smooth finished surface.

7 Claims, 1 Drawing Sheet

LIGHTWEIGHT INTERIOR MOULDING

TECHNICAL FIELD

The invention is directed to a lightweight gypsum coated decorative moulding, for installation on an interior building surface, the moulding having a polystyrene foam core coated with a rough textured acrylic matrix base coat and an acrylic based gypsum finish coat.

BACKGROUND OF THE ART

Interior decorative mouldings, such as crown mouldings, door and window casings, chair rails, baseboards, etc., are commonly used in the construction industry, typically having a flat surface on one side at least, and a decorative surface on the exposed other side. The flat side or sides are used for mounting to an interior wall surface.

The visually appealing decorative surface is usually formed in three dimensions with the moulding often having a uniform cross-sectional profile. A uniform cross-sectional profile is the simplest moulding to manufacture either of wood by milling the decorative surfaces, or in the case of extruded plastic moulding by extruding through a uniform profile die. Wood mouldings are commonly used, however the costs are becoming unacceptably high due to the labour intensive nature of the milling process and the gradual depletion of suitable forest wood stocks. Wood moulding typically must be clear of knots and must be of suitable consistency to produce a smooth finish surface. Wood mouldings tend to shrink and may crack or chip during handling and installation. Although, wood mouldings are in North America, the most common type of mouldings used, other less expensive alternatives are becoming popular.

Solid plastic and extruded polystyrene mouldings are also commonly available, however, with their own problems and costs associated. In general, extruded plastic mouldings are not preferred over wood mouldings due to the inability to finish joints properly, potentially toxic fumes which are produced during fires, and the fact that there is very little comparative cost advantage in using plastic mouldings.

Traditional construction methods include preparing solid plaster mouldings and this decorative style is regaining popularity. Complex moulded shapes can be produced with relative ease and improved safety during a fire is a distinct advantage gained through use of a solid plaster moulding. During Victorian times relatively large crown mouldings for example, were fairly common in homes or public buildings. To produce this traditional product, a prepared rubber mould is filled with a liquid plaster mixture to form moulding components of four to six foot length. Longer components are prohibitively heavy and are prone to crack when handled. Solid plaster mouldings are installed on site and painted like the adjacent wall and ceiling surfaces. Solid plaster of course, suffers from handling during installation and chips easily. A relatively high degree of skill is necessary to produce the rubber moulds and to install the moulding correctly without damaging the decorative surface. To provide additional strength and to resist cracking, the plaster mixture in older construction methods would be combined with horsehair, rope fibers or other natural fibers as reinforcement. Modern plastic fibers or fiberglass, Teflon, etc., can also be added to the plaster mixture for reinforcement.

It will be appreciated however, that the manufacture, handling and installation of traditional solid plaster moulding involves significant expense, skilled labour and expertise. Mass production of solid plaster mouldings has not occurred due to the high relative costs, and the inherent risk of damage during shipping and installation. Custom made solid plaster mouldings remain a viable option in historic renovation for example, or in building custom homes where a specific moulding must be matched or produced.

A significant advantage of solid plaster mouldings over wooden mouldings, plastic mouldings or polystyrene extrusions is in meeting fire regulations. High-rise condominiums or hotels, convention centers, theatres, or other high density buildings must meet higher fire codes standards than a low rise low density building or residence. Architects or interior designers may desire use of decorative mouldings in such buildings, however, to comply with fire regulations the mouldings must be coated with special flame spread resistant paints. In the case of wood mouldings, the wood itself adds to the flammable fire load within a building undesirably and extruded polystyrene or plastic mouldings may expose occupants to the risk of toxic fumes during combustion.

Fire codes generally specify the coating of mouldings or flammable materials with flame spread resistant paints or require that mouldings be coated with gypsum plaster. Wood and plastic mouldings can be coated with gypsum plaster by spraying for example. However, this procedure is also labour intensive and requires high level of skill. In the preparation of mouldings for picture frames for example, it is very common to coat wooden mouldings with plaster for decorative effects. This procedure however, involves high labour costs and is generally considered unsuitable for high volume building construction.

It is an object of the present invention therefore to produce a gypsum coated interior moulding which is low in cost and suitable for mass production.

It is a further object of the present invention to produce a light weight interior moulding which is gypsum coated in a manner such that special handling and installation methods are not required since the gypsum coating remains flexible and intact during handling and installation.

It is a further object of the invention to provide a light weight interior moulding which is of a weight such that the moulding can be installed with adhesives, and preferably with liquid gypsum compound as an adhesive, without mechanical fasteners or nails to simplify installation and to reduce the level of skill involved.

It is a further object of the invention to provide a gypsum coated light weight interior moulding secured to plaster walls and ceilings with gypsum compound as an adhesive to maintain the fire resistant properties of the gypsum coating and gypsum adhesive.

DISCLOSURE OF THE INVENTION

The invention provides novel lightweight gypsum coated decorative moulding, for installation on an interior building surface. The moulding is lightweight and flexible enough to withstand handling without cracking of the finished gypsum surface of the moulding. A gypsum coated surface is advantageous in that: fire resistance is enhanced; the moulding can be painted and repaired easily; and gypsum compound can be used as an adhesive to install the lightweight moulding without mechanical fasteners or other support. Bevel joints can be cut with standard carpentry tools and the joints can be bonded with gypsum compound as well.

The moulding has an elongated foam core of a resilient expanded polystyrene foam solid, having a cross-sectional profile proportionately smaller than the desired cross-sectional profile of the finished decorative moulding. The core has a rear surface, a decorative surface, and the rear surface includes at least one elongate mounting face for mounting the moulding to the interior building surface.

Covering the decorative surface of the foam is a base coating core of hard granular particles, such as silica sand, suspended in an acrylic matrix. The base coating is adapted for liquid application and is cured to produce a relatively rough surface.

Covering the base coating on the decorative surface, is a finish coating of powdered gypsum also suspended in a liquid acrylic matrix. The finish coating is adapted for liquid application and is cured to produce a relatively smooth finished surface.

Further details of the invention and its advantages will be apparent from the detailed description and drawings included below

BRIEF DESCRIPTION OF THE DRAWINGS

In order that the invention may be readily understood, one preferred embodiment of the invention will be described by way of example, with reference to the accompanying drawing wherein.

DETAILED DESCRIPTION OF PREFERRED EMBODIMENTS

Figure 1:
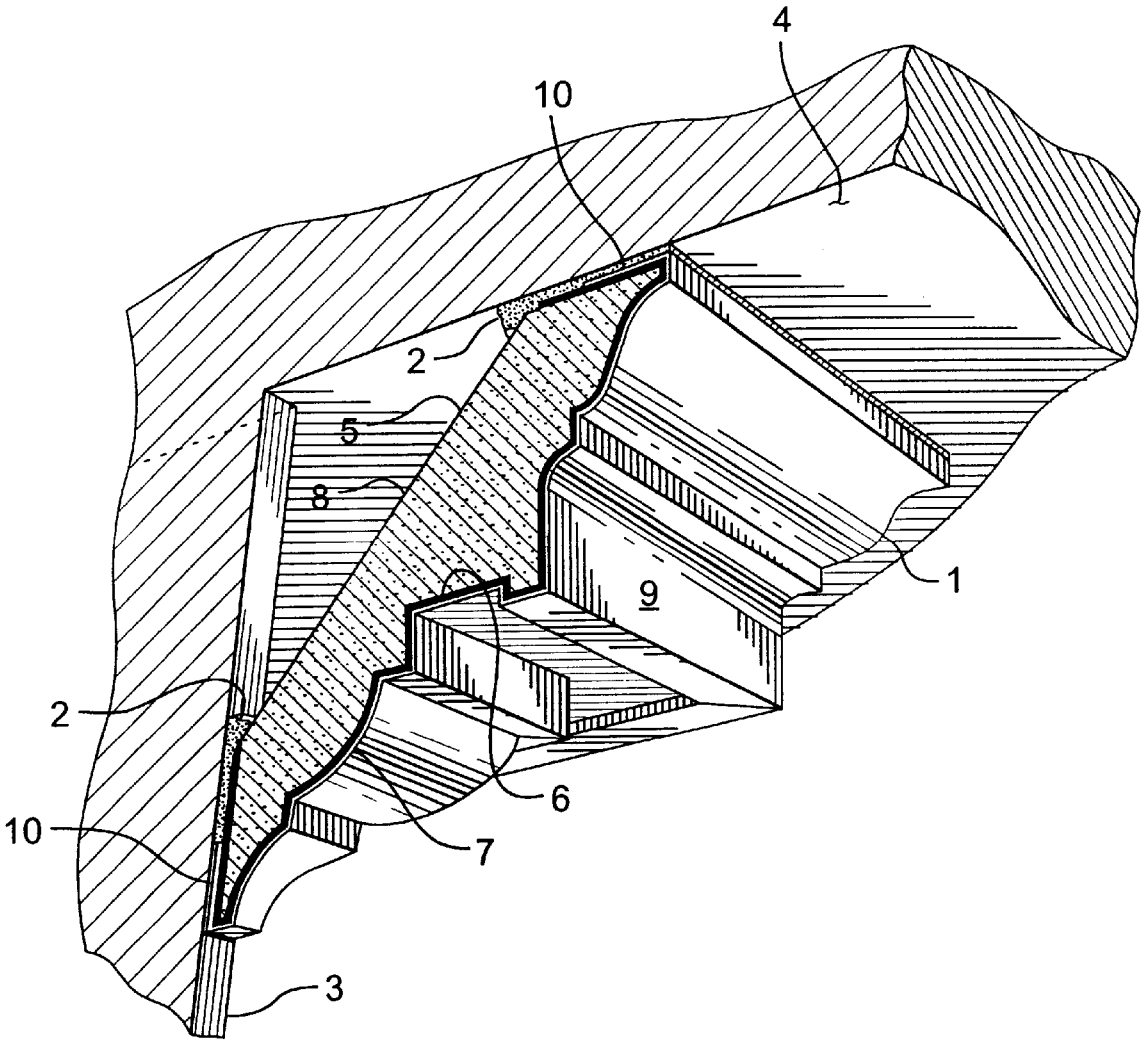
FIG. 1 is a perspective view of a installed crown moulding on an outside corner, including a vertical section through the crown moulding, and through the wall and ceiling upon which the moulding is mounted with liquid gypsum compound, to illustrate the foam core, base coating and finish coating together with the gypsum compound adhesive installation.

FIG. 1 illustrates a light weight gypsum coated decorative moulding 1 which in the embodiment illustrated is a crown moulding mounted with a liquid gypsum curable gypsum compound 2 to a plaster covered wall 3. The moulding 1 is light weight such that the adhesive properties that liquid gypsum compound 2 are sufficient to secure the moulding 1 in its installed position until the gypsum compound 2 dries completely. Use of gypsum compound as an adhesive provides a complete gypsum coated exterior between the ceiling 4 and moulding 1 and the wall 3 and moulding 1. No mechanical fasteners are required in contrast to the relatively heavier wooden or solid plaster mouldings of the prior art. Use of liquid gypsum compound 2 as an adhesive also eliminates the risk of contaminating the gypsum coated plaster surfaces of the wall 3, ceiling 4 or moulding 1 with adhesives that are not compatible and could detrimentally effect the finished plaster surfaces or paint applied thereto.

The light weight gypsum coated decorative moulding 1 is manufactured first by accurately cutting an elongate foam core 5 from resilient expanded polystyrene foam solid. Preferably the foam core 5 is high density or double density polystyrene cut with a highly accurate hot wire cutting machine controlled by computer numerical controls. Such machines are commonly used in this art and need not be described herein.

Preferably the foam core 5 is manufactured to extremely close tolerances such as ±1/64". Such close tolerances are essential to producing a smooth finish and uniform thickness of coating. It will be appreciated that if the foam core 5 is out of tolerance and the thickness of the coatings are also out of tolerance, the cumulative effect of these inaccuracies can lead to severe mismatching of the finished outer surfaces of moulded units installed side by side. In contrast, prior art wood moulding is produced in a single manufacturing step by milling the finished surface of the moulding which ensures that uniform profile is maintained. In a like manner, the profile of an extruded plastic moulding is controlled by extrusion through a single mould in highly accurate extrusion processes.

The present invention however relies on the cumulative accuracy of the three steps of cutting the foam core, then applying a base coat 6 and a finish coat 7, all in a highly accurate manner to produce a finish surface within an acceptable reproducible tolerance.

The elongate foam core 5 has a cross-sectional profile proportionally smaller than the desired cross-sectional profile of the finished decorative moulding 1. The foam core 5 is produced with a rear surface 8 and a visible decorative surface 9. The rear surface 8 is generally not visible when installed and includes at least one (in the illustrated case two) elongate mounting faces 10 for mounting the moulding to the interior building wall 3 and ceiling 4 surfaces. It will be understood that the invention is equally applicable to other conventional interior moulding profiles other than crown moulding illustrated. Other moulding examples include, chair rails, baseboards, door and window casings, etc.

The decorative surface of the foam core 5 is initially coated with a base coating 6 preferably by passing the core 5 through a die thereby producing a uniform base coat 6 thickness. The details of this method are not considered crucial to the present invention and are part of the prior art published in U.S. Pat. No. 5,672,391 issued Sep. 30, 1997 to the present inventor and applicant. By passing the foam core 5 through a first die which is approximately $1/16^{Th}$ of an inch larger in profile than the accurately foam core 5, the base coat 6 applied in liquid form in advance of the die is uniformly applied in a thickness of approximately $1/16^{Th}$ of an inch to the surface of the foam core as the foam core 5 is passed through the first die.

The finished coating 7 is applied in a like manner, however the finishing die is approximately 1/32" larger than the die through which the base coating is applied in order to result in a finish coating of approximately of 1/32" thickness.

It has been found by extensive experimentation that direct application of a gypsum finish coat 7 to a foam solid core 5 produces completely unacceptable results. Directly applying gypsum compound as a finished coat 7 to a foam core 5 produces an extremely unstable coating which easily cracks or crumbles during installation and shipping to the construction site.

It has also been found to be extremely difficult to produce a finish coating surface that is acceptably smooth for painting and suitable for interior decorative use. The maintenance of high accuracy dies and highly accurate cutting of the foam core 5 are important to the production of a smooth finished surface.

It has also been found by extensive experimentation that a conventional gypsum powder in aqueous suspension is not suitable for production of a resilient gypsum finish coating 7. A gypsum compound coating does not bind correctly to the foam core since the polystyrene foam 5 and gypsum coating repel each other and do not result in a reliable bond between the foam core 5 and the finish coat 7.

In addition it has been found that applying more than one coating of gypsum compound results in bonding difficulties between successive gypsum compound layers. The invention supplies a solution to this difficulty as follows.

A base coating 6 is applied which produces a rough surface when cured, by mixing hard granular particles, such as sand, suspended in a liquid acrylic matrix. The sand and acrylic base coating 6 is adapted for liquid application through a die and cures to produce a relatively rough surface on its exterior. In addition, the acrylic matrix produces a superior bond to the polystyrene foam core 5. The acrylic when cured is highly flexible, resilient and withstands handling during manufacture, storage, shipping and installation. Other readily available natural or synthetic hard granular particles may also be utilized provided they are graded for size and are chemically compatible with the acrylic matrix binder.

To produce a gypsum coated smooth exterior finished surface, a finished coating 7 is applied on the decorative surface 9. The finished coating 7 is made of powdered gypsum suspended in an acrylic matrix compatible with the base coating 6. The finish coating 7 is also adapted for liquid application through a die as described above and cures to produce a relatively smooth gypsum finish surface. The precise compositions of the base coating 6 and finish coating 7 depend on several factors such that some fine tuning or limited experimentation is necessary to produce the desired results in the finished product. For example the specific temperature and humidity of the manufacturing facility within which the coatings 6, 7 are applied and the viscosity of the base coating 6 and finish coating 7 mixtures, can have significant effect upon the application rate and the cured finished surfaces of the coatings. The speed at which the foam core 5 is passed through a die, the size of high granular particles in the base coating 6 and size of gypsum powder particles in the finish coating 7 also have significant effect upon the results obtained.

It has been found however, that suspending sand or other hard granular particles in an acrylic matrix for the base coat 6 and powdered gypsum in an acrylic matrix for the finish coating 7 produce a resilient highly durable decorative surfaces which bond to the expanded polystyrene foam solid 5 in a highly satisfactory manner. The inherent resilience in the polystyrene foam solid 5 and the flexible acrylic matrix of the base coating 6 and finish coating 7 produce a finished decorative moulding which is highly flexible, resists cracking and withstands handling and installation in a manner superior to comparable wood or solid plaster mouldings.

As shown in FIG. 1, preferably the mounting faces 10 are adapted to bind with adhesive materials to the building wall and ceiling surfaces 3 and 4. Synthetic adhesives such as glue can be used. However, in order to produce a completely enclosed gypsum coated interior surface, for fire and health reasons the illustrated embodiment shows a preferred embodiment where mounting faces 10 are adapted to bind with liquid gypsum curable material 2 to gypsum coated building wall and ceiling surfaces 3 and 4.

To ensure the secure mounting of the moulding 1 to the wall 3 and ceiling 4, the illustrated embodiment preferably shows that the mounting faces 10 are also coated with the base coating 6 and finish coating 7. In this manner, it is ensured that the gypsum coated wall 3 and ceiling 4 surfaces, the gypsum coated finish coat 7 of the interior moulding 1, and the liquid gypsum curable adhesive 2 are completely compatible. Use of other materials as an adhesive is of course possible, however staining or incompatibility with the plaster surfaces 3 and 4 may be of concern. As well when liquid gypsum compound 2 is used, any spillage any overflow which oozes out of the compressed joints can be easily wiped away and will not detrimentally effect the subsequent painting or finishing of the moulding or wall surfaces 3 and 4.

In the embodiment illustrated, the moulding 1 is wrapped around an outside corner. In order to produce such details, the moulding 1 is simply cut in an manner similar to wooden moulding on a mitre chop saw or with other conventional carpentry cutting tools. The acrylic base finish coating and base coating do not chip when cut in this manner and present no difficulty during use of conventional woodworking tools.

Joints between adjacent decorative moulding components are coated with liquid gypsum curable materials 2 as an adhesive and the liquid gypsum fills any voids or gaps between the adjacent decorative moulding components. Joints between adjacent moulding components do not require substantial adhesive bonding and the presence of liquid gypsum material 2 merely serves to fill gaps or voids and produce an acceptable finished appearance. The strength of connection between adjacent decorative moulding components is ensured by the bonding on the mounting surfaces 10 and not by the cut faces of the moulding.

The details of the moulding construction are as follows. As mentioned above, the foam core 5 has a cross-sectional profile which is preferably with a hot wire CNC machine to a tolerance of ±1/64". The base coating 6 is applied to have a cured thickness of 1/16" or less. The finish coating 7 is also applied to have a cured thickness of 1/32" or less. Highly accurate production and manufacture of dies are required to ensure that the close tolerances are met. Failure to produce such accurate coating and shape tolerances will result in cumulative inaccuracies, which produces an unacceptable finished or cured thickness. Apart from appearances, in order to comply with fire regulations, it is necessary to ensure that the interior moulding has sufficient cured thickness of gypsum finish coating 7.

The resulting interior moulding has the benefit of extremely low unit weight for a gypsum coated moulding and this low weight enables the simplification of installation as described in detail above. Wooden mouldings or solid gypsum mouldings for example, usually require mechanical fasteners to ensure that the mouldings are retained in place.

Use of a expanded polystyrene foam solid 5 and relatively thin base coating 6 and finish coating 7 result in a finish moulding 1 which is of unit weight in the range of 0.25 to 0.875 pounds per linear foot. In addition the foam core 5 itself can be hollowed out to reduce weight depending on the nature of the particular moulding in question.

However, it is considered that common unit weights for finished moulding will be in the range of 0.5 to 0.625 pounds per linear foot, which is compatible with the weight of equivalent wood moulding.

The base coat 6 can be produced with hard granular particulars of any acceptable nature compatible with acrylic matrix in order to properly bond with the foam core 5 and produce a relatively rough external surface for bonding to the finish coating 7. Examples of such hard granular particles are polystyrene beads or sand particles of size ranging between 14 and 70 US screen mash standard. Commonly available sand particles and other commercially available hard granular particles are available usually in sizes between 20 and 50 US screen mash standard. However, it will be understood that other granular particles may be utilized to equal advantage depending on the particular installation and manufactured procedures adopted.

As described above, therefore the invention provides a lightweight interior moulding which is relatively inexpensive to produce and install. A significant advantage of providing a gypsum coated lightweight foam moulding is that fire regulations can be met in an economical manner. The gypsum coating provides for flame resistance and fire spread resistance specially when combined with gypsum coated walls and ceiling structures. The use of gypsum liquid mixture as an adhesive simplifies installation and reduces labour costs as well as providing a continuous fire barrier of gypsum. The resulting installation is easily painted with conventional methods. Advantageously, the moulding is reparable with conventional plastering techniques and is highly resistant to damage during transport and installation due to it's lightweight and flexibility.

Although the above description and accompanying drawings relate to a specific preferred embodiment as presently contemplated by the inventor, it will be understood that the invention in its broad aspect includes mechanical and functional equivalents of the elements described and illustrated.

The embodiments of the invention in which an exclusive property or privilege is claimed are defined as follows:

1. A lightweight gypsum coated decorative moulding, for installation on an interior gypsum coated building surface, the moulding comprising:

an elongate foam core comprising a resilient expanded polystyrene foam solid, having a cross-sectional profile proportionately smaller than the desired cross-sectional profile of the finished decorative moulding, the core having: a rear surface; a decorative surface; and the rear surface including at least one elongate mounting face for mounting the moulding to the interior building surface;

a base coating covering the decorative surface of the foam core comprising hard granular particles suspended in an acrylic matrix, the base coating adapted for liquid application and cured to produce a relatively rough surface; and a finish coating covering the base coating on the decorative surface, the finish coating comprising powdered gypsum suspended in an acrylic matrix, the finish coating adapted for liquid application and cured to produce a relatively smooth finished surface wherein each mounting face is coated with said base coating and said finish coating and the finish coat on each mounting face is adapted to bind with liquid gypsum curable material to the interior gypsum coated building surface.

2. A lightweight interior moulding according to claim 1 wherein the base coating has a cured thickness of $1/16^{th}$ of an inch or less.

3. A lightweight interior moulding according to claim 1 wherein the finish coating has a cured thickness of b $1/32^{nd}$ of an inch or less.

4. A lightweight interior moulding according to claim 1 wherein the moulding has a unit weight in the range of 0.25 to 0.875 lbs./linear ft.

5. A lightweight interior moulding according to claim 4 wherein the moulding has a unit weight in the range of 0.5 to 0.625 lbs./linear ft.

6. A lightweight interior moulding according to claim 1 wherein the hard granular particles of the base coating comprise sand particles of size ranging between 14 and 70 U.S. screen mesh standard.

7. A lightweight interior moulding according to claim 6 wherein the sand particles are of size ranging between 20 and 50 U.S. screen mesh standard.

* * * * *

UNITED STATES PATENT AND TRADEMARK OFFICE

CERTIFICATE OF CORRECTION

PATENT NO. : 6,253,510 B1
DATED : July 3, 2001
INVENTOR(S) : Ned Santarossa

It is certified that error appears in the above-identified patent and that said Letters Patent is hereby corrected as shown below:

Title page,
Item [73], Assignee, replace "Ontario Limited" with -- 888804 Ontario Limited --.

Signed and Sealed this

Fifth Day of February, 2002

*Attest:*

*Attesting Officer*

JAMES E. ROGAN
*Director of the United States Patent and Trademark Office*